United States Patent [19]

Remmert

[11] 3,989,073

[45] Nov. 2, 1976

[54] APPARATUS FOR ATTACHING VALVE BAGS TO FILLING SPOUTS OF FILLING MACHINES

[75] Inventor: Josef Remmert, Vorhelm, Germany

[73] Assignee: Bernhard Beumer Maschinenfabrik KG, Beckum, Germany

[22] Filed: May 7, 1975

[21] Appl. No.: 575,179

[30] Foreign Application Priority Data

Feb. 20, 1975 Germany ..... 2507214

[52] U.S. Cl. ..... 141/315; 53/188

[51] Int. Cl.[2] ..... B65B 1/04

[58] Field of Search ..... 141/10, 67, 68, 114, 141/129–191, 313–317; 53/188

[56] References Cited

UNITED STATES PATENTS 870,215 11/1907 Bates ..... 141/68

*Primary Examiner*—Houston S. Bell, Jr.

*Attorney, Agent, or Firm*—Edwin E. Greigg

[57] ABSTRACT

An apparatus for mounting valve bags on the filling spouts of machines which fill the bags with finely-grained material, e.g. cement. The bags are folded flat and are stacked in a bag storage container. A feed mechanism removes the topmost bag from the stack and positions it in the path of a pivotal arm. The arm is provided with rollers which correctly position and shape the top of the bag and open the valve therein. Lever-actuated clamps hold the bag while it is mounted on the filling spout of the filling machine.

In a variant of the invention, the bag feeding mechanism rotates and occupies successive stations, one of which is traversed by the pivotal arm which removes the bag from the mechanism for mounting on the filling spout.

32 Claims, 14 Drawing Figures

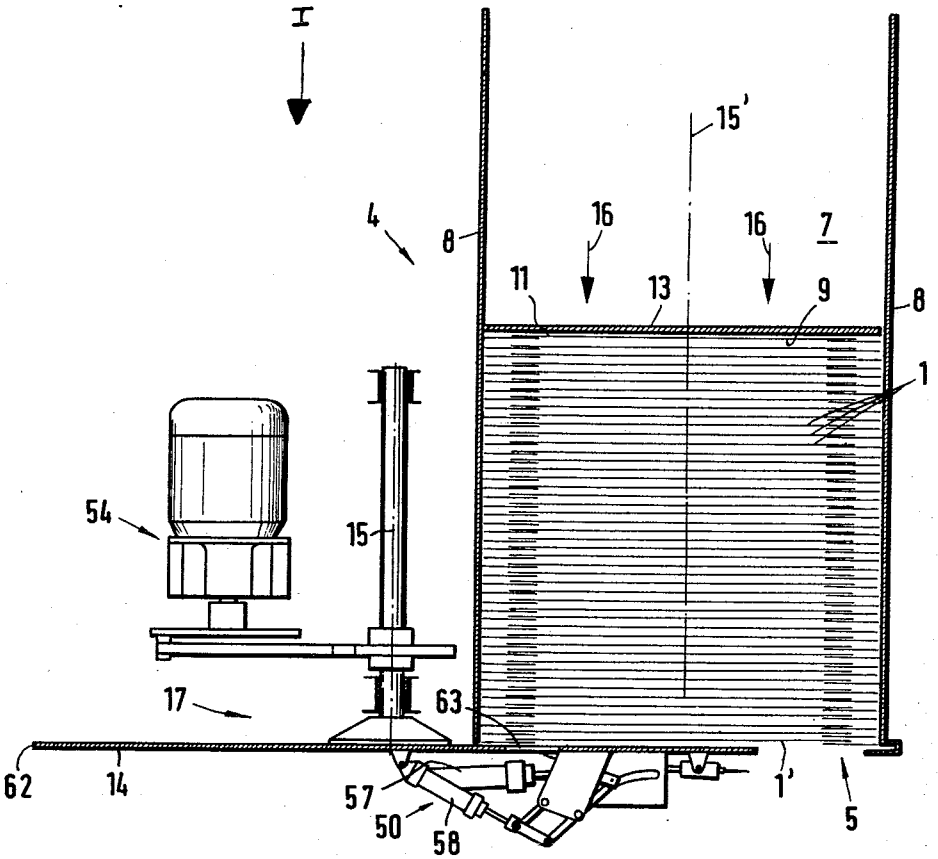
Fig.9
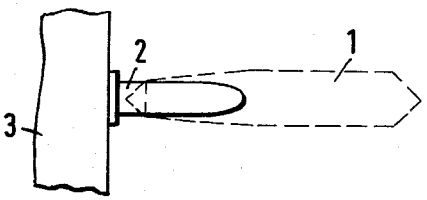

21
42
41
9
1'
61
56
41'
42'
20
50
58
15
14

55
50'
59
57

APPARATUS FOR ATTACHING VALVE BAGS TO FILLING SPOUTS OF FILLING MACHINES

BACKGROUND OF THE INVENTION

The invention relates to an apparatus for attaching a valve bag to the filling spout of a filling machine. Valve bags are intended to be filled with pourable material, especially with finely grained pourable material such as cement, and the apparatus includes a storage container for holding a supply of valve bags. The apparatus further includes means for receiving a bag to be attached, as well as means for opening the valve portion of the bag. The receiver means and the opening means are attached to a pivotal arm which picks up the bags, one at a time, opens their valve and thereafter mounts them on the filling spout.

The invention further relates to a filling machine for filling valve bags with finely grained pourable material such as cement, which rotates about a vertical axis and whose circumference is provided with several, mutually displaced filling spouts on which valve bags are mounted to be filled.

Nowadays, the filling of bags with finely grained materials such as cement is almost always done with the aid of filling machinery which has several filling spouts through each of which the material is delivered to a particular bag. The bags which are usually employed are so-called valve bags which are almost always made of paper of different strength, but could, in principle, be made, for example of plastic such as polyethylene.

A valve bag of this type has a front side and a back wall as well as a bottom and a top. When the bag is stored, the bottom and top portions of the bag are folded over and attach to the front or back wall. The top of the valve bag is similar to its bottom, i.e. it is substantially closed on all sides, but in the end portion of the top, near one of the edges of the bag, there is provided a filling aperture which is also called a "valve", from which this type of bag derives its name. In the vicinity of the valve, the top of the bag is provided with a tab which gives it a double-walled configuration through which the filling spout is inserted. When the bag is being filled, the material poured into the bag rises toward the top and eventually pushes the tab located underneath the main top surface upwardly, so that when the bag is removed from the filling spout, it is in a substantially closed, filled-up condition.

Even at the present time, the valve bags described above are mounted on filling spouts of filling machines mostly by hand. It is obvious that the above described process requires substantial manual labor and is correspondingly expensive. In principle, the repetitive nature of the process of mounting such bags suggests mechanization but, apparently, the properties of the valve bags whose shape is not stable and the properties of the filling material have been such that this process has had to be performed mostly by hand.

Further, it is to be noted that, in the first instance, a valve bag must be taken from the storage container and must then be manipulated in a certain manner prior to being mounted on the filling spout. This manipulation includes, firstly, bending the top of the bag up from its normally parallel storage position, in which it attaches to the front or back wall of the bag, and, subsequently, opening the valve by lifting or spreading apart of the two top regions of the bag which form the valve.

Yet it is not alone for reasons of costs that the manual operation is extraordinarily unsatisfactory. For in addition, the filling machines used nowadays (and this is equally true for series construction or carousel type construction), have such short cycling times (i.e., substantially filling times), that they cannot be fully utilized and exploited by servicing the spouts by hand even though short filling times are extremely desirable for reasons of economy. This condition is especially prevalent when a single operator is required to service several filling spouts, which is usually the case. The result is not only poor exploitation of the capabilities of the filling machine, but, because a manual operation is necessarily somewhat irregular, the delivery of filled-up bags also becomes irregular and it is unavoidable that, at times, two or sometimes even more filled-up bags topple over one another on the conveyor means associated with the filling machine.

Therefore, it has recently been attempted to perform the bag mounting process by machine. For example, a mounting apparatus has been disclosed in which bags, which are stored in the storage container in a position in which their front and back walls are essentially horizontal, are lifted at the middle from below by lifting means so as to obtain a substantially flat top surface of the stack of bags in the container. This step is required because the bags are thicker at the end and at the top than they are in the middle. Located above the bag storage container is a receiver head with two slides which are movable in the horizontal plane. When a bag is to be grasped, the head is lowered onto the stack of bags. Subsequently the two slides are extended laterally until they enter the fold between the back of the bag and its bottom or its top, respectively. Subsequently, the head is lifted up again. In the raised position of the head, one of the slides is turned up by 90° so that the bag assumes an L-shaped configuration and is now located at some considerable distance from the stack of bags in the container. Subsequently, the raised head is moved into a claw which, when it closes, grasps the bag adjacent to its top and opens the valve. The claw then removes the bag from the apparatus, thus disengaging the bottom of the bag from its associated slide so that the horizontal portion of the bag flops down. Finally, the gripper claw pushes the bag onto the filling spout and releases it, terminating the mounting process.

The above-described movements of the individual members of the known apparatus must then be repeated in the opposite sense to complete the entire cycle, and the gripping claw must thus re-enter the apparatus. Subsequently, the head must be returned, the turned-up slide must be lowered, and the entire head must be lowered as well. Finally, the slide must be retracted into the head. These individual movements are effected by means of a suitably complicated pneumatic actuating system which performs all the required control functions.

Thus it will be appreciated that this relatively complicated series of movements is not only correspondingly costly, but a necessarily considerable amount of time is required to complete the bag-mounting process, since certain minimum times to perform the individual mechanical movements simply cannot be reduced.

A further disadvantage of this known apparatus is that the control elements, the drive means, and all the other movable parts cannot be sealed with respect to the exterior because the final movement is that of the gripper claw which holds the bag leaving the apparatus.

This exposure leads to quite serious disadvantages. For, during the operation of the machine, it is unavoidable that, occasionally, a bag is either intrinsically faulty or that it bursts during the filling process, and in that case, filling material is necessarily blown directly into the bag-mounting apparatus, at least temporarily. When the filling material is cement, for example, this contamination is extraordinarily unwelcome and necessarily leads to operational malfunctions since it is well-known that pneumatic or hydraulic actuators or drive means are extremely sensitive to contamination by such fine grained, pourable material.

For this reason, it has already been attempted to accelerate the working cycle by simplification of the movements and by a reduction in the number of constructional elements, control elements, etc. Thus for example, an apparatus of the above-described type has been disclosed in which several suction cups, disposed on the pivotal arm, are attached to the horizontally positioned top of the uppermost bag within a bag storage container, after which suction is applied so as to remove the particular bag from the stack in the container. Subsequently, the bag is moved into a vertical position so that it may be mounted on the filling spout after its valve means have been opened. The opening of the valve is also performed by suction cups in this known apparatus: the suction cups pull the top of the valve bag upwardly so as to flip the valve open.

It has been shown that even this known apparatus does not meet the demands made of it. For even here, several different movements are still required, each consuming a considerable amount of time, so that the total cycling times are still felt to be too high and do not permit an optimum exploitation of the potential capacity of modern filling machines.

The use of suction cups and vacuum systems brings a substantial further disadvantage, for it is well-known that such elements do not permit satisfactory operation when handling very finely grained material such as cement because this material quickly adheres to the suction cups and the vacuum system and renders them inoperative.

OBJECT AND SUMMARY OF THE INVENTION

It is a principal object of the invention to provide an apparatus of the type described above which is so improved that it prevents the occurrence of the above-cited disadvantages by performing the bag-mounting process without unnecessary movements so that the short filling times of which modern filling machines are capable are fully exploited. Furthermore, the efficiency and economy of the apparatus can be substantially increased by considerable enlargement of the capacity of the bag storage container and the machine can operate automatically even when using unfavorable filling material such as cement and yet operate with high operational reliability. In addition, the apparatus may be operated manually at will, for example during malfunctions.

These and other objects are attained by the invention by providing a bag mounting apparatus which includes a pivot arm with fold-over means located at the end of the arm remote from its pivotal point. The fold-over means may be brought into engagement with the top of an individual bag during the pivotal motions of the arm. Due to this engagement, the fold-over means folds the top of the bag over into a position which is substantially perpendicular to the large walls of the bag (i.e., the front or the back of the bag), the fold-over means also pushes the longitudinal edge regions of the top of the bag downwardly with respect to the center line of the top, with the result that the top of the bag assumes a roof-shaped cross-section.

The invention will be better understood and further objects and advantages will become more apparent from the ensuing detailed specification of two exemplary embodiments taken in conjunction with the drawing.

BRIEF DESCRIPTION OF THE DRAWING

FIG. 9 is a top view of the apparatus according to FIGS. 7 and 8 seen in the direction of the arrow III in FIG. 7;

DESCRIPTION OF THE PREFERRED EMBODIMENTS

Figure 1:
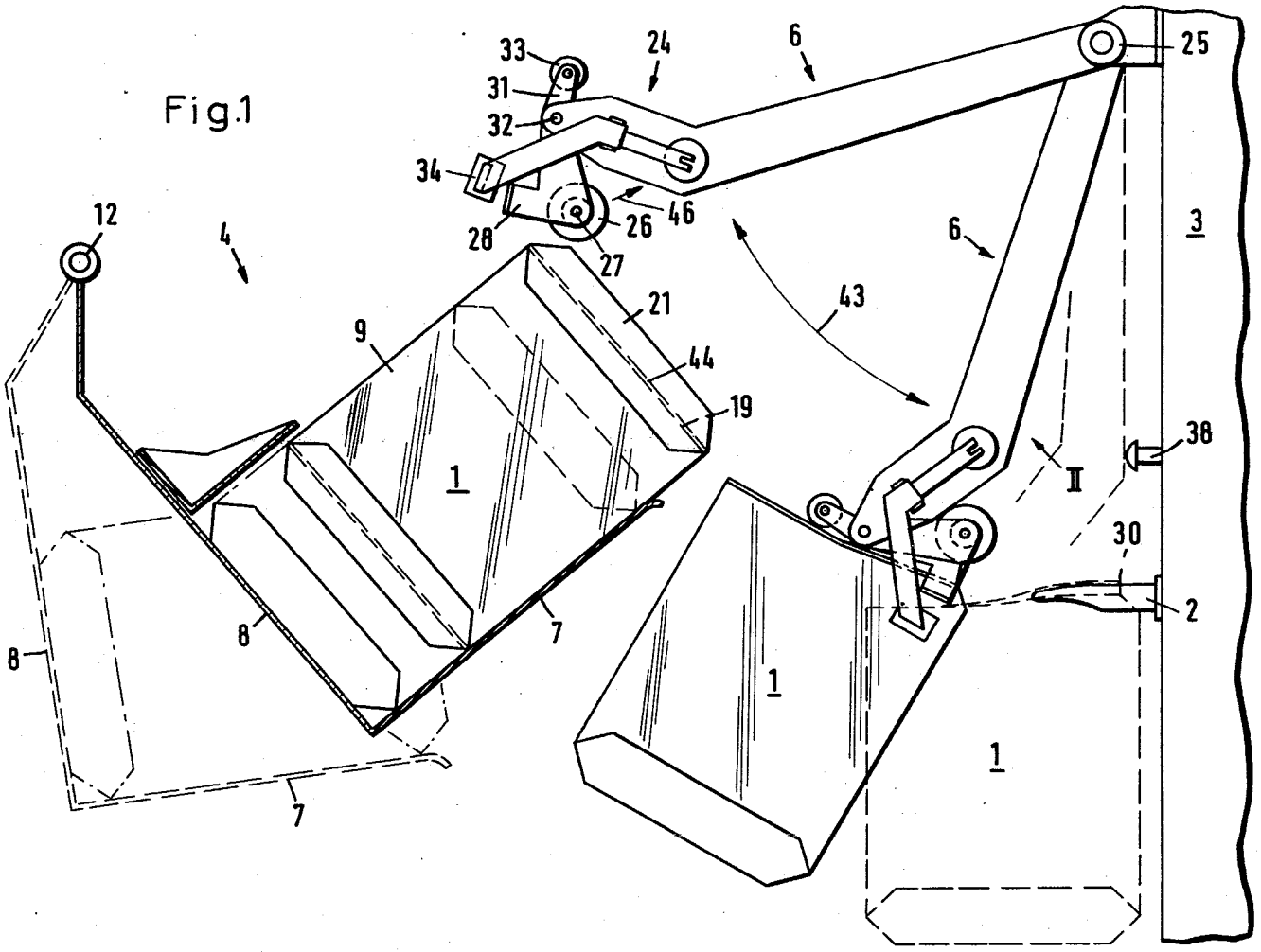
FIG. 1 is a side elevational view of an apparatus for attaching valve bags to the filling spout of a filling machine; only essential elements of the apparatus have been shown for clarity.

Turning now to FIG. 1, there may be seen a schematic representation of an apparatus according to the invention for mounting valve bags 1 on the filling spout 2 of a filling machine 3.

The apparatus comprises a bag storage container 4 as well as a pivotal arm 6, both of which will be described in detail below.

The bag storage container 4 has two mutually perpendicular support panels 7 and 8 for holding the stored bags 1. These support panels are disposed so that the front walls 9 or the rear walls 11 of the bags 1 lie in a substantially vertical plane as may be seen in FIGS. 1, 4 and 5. These figures also show that the support panels 7, 8 in the embodiment according to FIGS. 1–6 are inclined with respect to a vertical or horizontal plane. The angle of inclination of the support panels may be changed by pivoting the entire container 4 about the joint 12 and fixing it in the chosen position by means of fastening means not shown.

Figure 3:
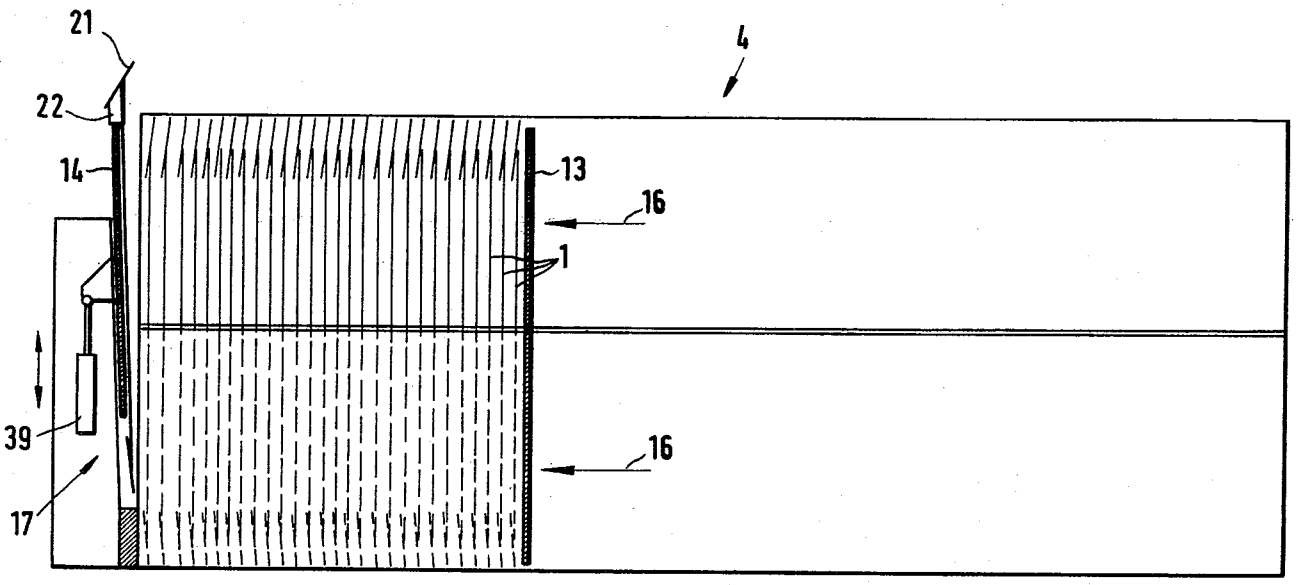
FIG. 3 is a view of the bag storage container according to FIG. 4, as seen in the direction of the arrow III.
Figure 4:
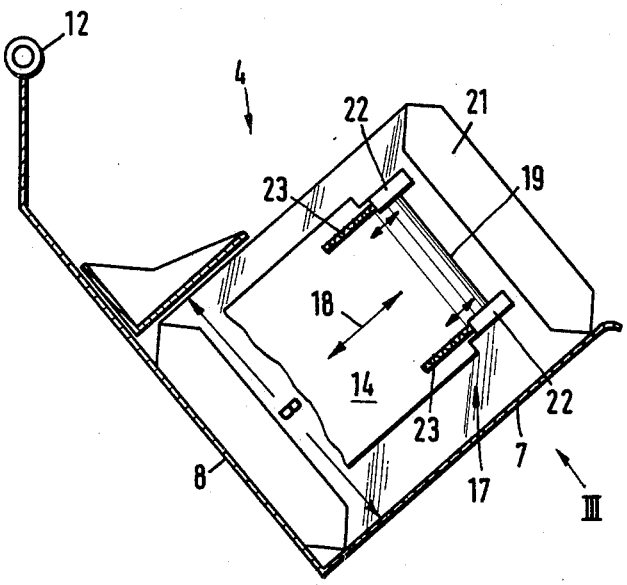
FIG. 4 is a side elevational view of the bag storage container according to FIG. 3 as seen in the direction of the arrow IV, prior to an individual bag having been removed from the stack.

As may be seen especially from FIG. 4, the bags 1 stored in the container 4 are held between two mutually movable stop means 13 and 14 which compress the stack of bags 1 in a direction normal to their front or rear walls 9 and 11 (FIG. 6), respectively, and generally in the direction of the arrow 16. The stop means 13, 14 are embodied as plates disposed parallel to the front or rear walls 9 or 11, respectively, of the bags 1. One stop 13 may be moved in the direction of the arrows 16 (FIG. 3), whereas the other stop 14 is locally fixed with respect to motion along the arrow 16. Located in the vicinity of the locally fixed stop 14 is a pressure relief mechanism (not shown) by which the bags 1 may be pushed away from the locally fixed stop 14 in the direction of the movable stop 13 (i.e., in the direction opposite to arrows 16), whenever a single bag 1 is to be removed from the bag storage container 4 but this particular bag will not be engaged by the relief mechanism.

Also, located on the bag storage container 4 in the vicinity of the stop 14 is a single bag feed mechanism 17 designed to displace one of the bags 1 from the stack of bags for ultimate removal by the means disposed on the pivotal arm.

The single bag feed mechanism 17 has a slide which may move within limits in a direction parallel to the front wall 9 or the rear wall 11 of the bag, i.e., in the direction of arrow 18 (FIG. 6) and this slide is identical with the locally fixed stop 14. The upper edge 19 of the slide 14 is intended to engage the top 21 of the particular bag 1 as will be further explained with reference to FIG. 6. The upper edge 19 of the slide 14 which moves in the direction of the arrow 18 extends over approximately ⅔ of the width B of the bag 1 and includes lifters 22 which bend the top 21 of the particular single bag 1 out of the position in which contacts the front 9 or the rear 11 of the bag and into an oblique position with respect to the bag walls. The lifters 22 taper to an edge, as can be seen especially in FIG. 6, and may move slidably with respect to the slide 14 in the longitudinal direction 18 and against the force of springs 23.

Figure 2:
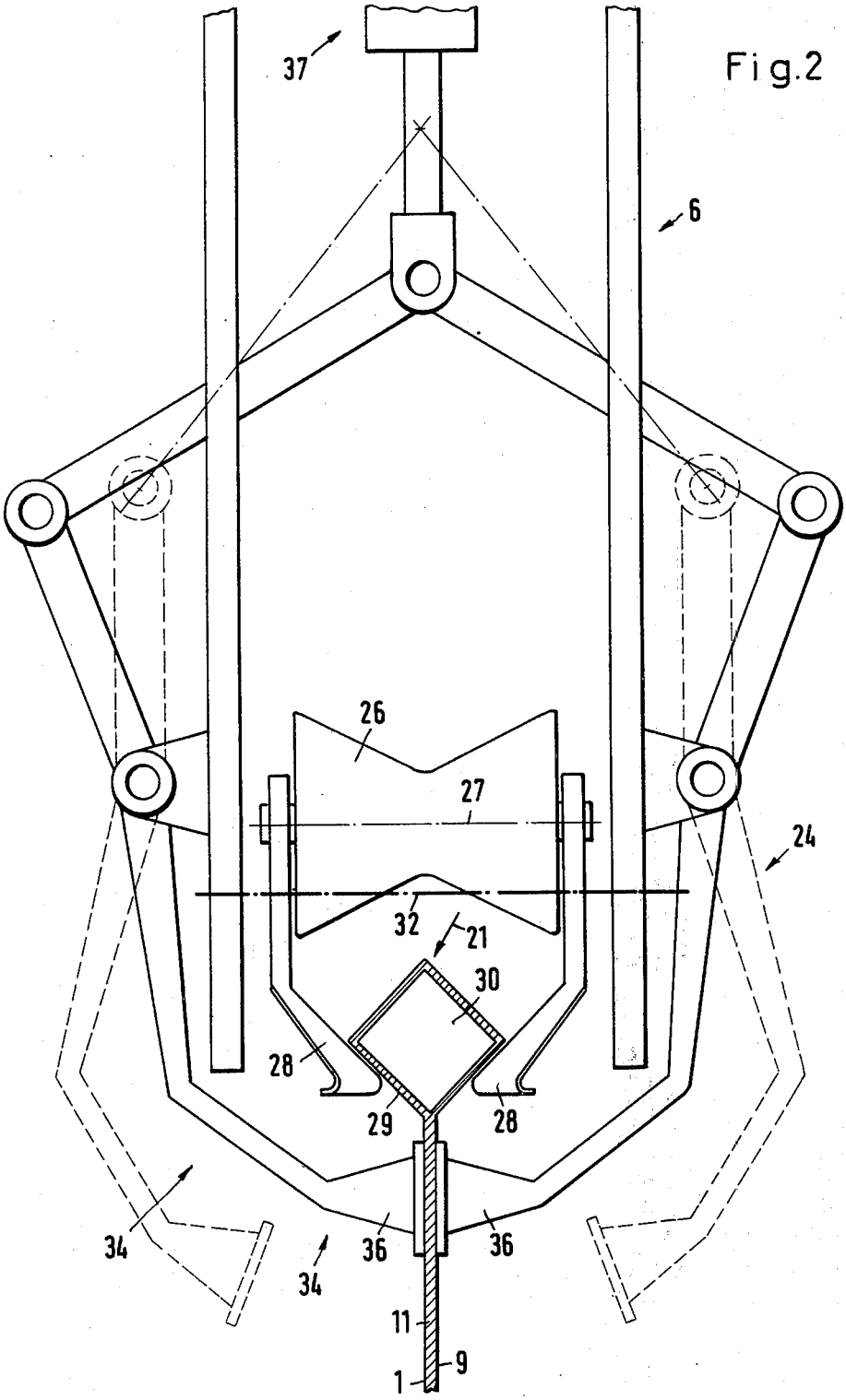
FIG. 2 is an enlarged view of the pivotal arm approximately as seen in the direction of arrow II in FIG. 1.

As may be seen from FIGS. 1 and 2, the end of the pivotal arm 6 remote from its pivoting location 25 is provided with fold-over means 26 embodied as a roller. The roller may rotate about a pivotal axis 27 disposed perpendicular to the pivotal plane of the pivoting arm 6 and its longitudinal cross-section has the form of a double cone with adjoining apices so that the diameter of the roller increases from the center to both ends. The fold-over means 26 automatically folds over the head of each individual bag so that it lies perpendicular with respect to the front 9 or the rear 11 of the bag 1 during the downward pivoting of the pivotal arm 6, as will be explained in more detail below. The free end region of the pivot arm 6 also carries a funnel-shaped opening member 28 for opening the valve means 30 on the individual bag 1. The opening means 28 has a slotted passage at the bottom so that the upper end region of an individual bag 1 can enter there as may be seen especially from FIG. 2.

The opening means 28 and the fold-over means 26 are located on a common support embodied generally as a seesaw 31. The seesaw 31 has a first position in which the fold-over means 26 engages the top 21 of an individual bag 1 and it may pivot about the pivotal axis 32 to occupy a second position in which the fold-over means 26 no longer engages the top 21 of the bag 1. The elements on the seesaw are so located that the opening means 28 engages the top 21 of the bag 1 when the seesaw 31 tips over into its second position and this engagement is maintained until the seesaw 31 is tipped back into its first position. The seesaw is tipped by the force exerted by the slide 14 of the single bag feed mechanism 17 on the fold-over means 26.

As may be seen in FIG. 1, the opening means 28 and the fold-over means 26 are both located at one end of the seesaw 31, whereas the other end of the seesaw 31 is equipped with a pressure stop means 33 which engages the top 21 of the individual bag 1 in the second position of the seesaw. The pressure stop means 33 is also embodied as a roller.

The free end region 24 of the pivotal arm 6 also supports a receiver embodied as a clamping means for receiving the individual bag to be mounted on the filling spout 2. The clamping means, as may be seen in FIG. 2, is embodied as a system of levers. Two opposing, pad-like lever arm regions 36 clampingly engage that end of the top of the bag which includes the valve 30. The receiver 34 is driven by a cylinder-piston assembly 37. A switch 38 serves to disengage the receiver 34 from the bag when the valve 30 has been placed over the filling spout 2.

The method of operation of the above-described apparatus according to FIGS. 1 to 6 is as follows:

At the start, the bags 1 are stacked in the bag storage container 4, as may be seen in FIGS. 3 and 4. An individual bag is removed from the front of the stack by actuating the slide 14 with a cylinder-piston assembly 39 so that it moves outwardly in the direction of the arrow 18. During this motion, the tapered outer edges of the lifter means 22 enter the bag fold 41 (see FIG. 6) and thus move the top 21 of the individual bag into the oblique position shown in broken lines in FIG. 6 which insures that the upper edge 19 of the slide 14 may enter the fold 41 without hindrance.

Figure 5:
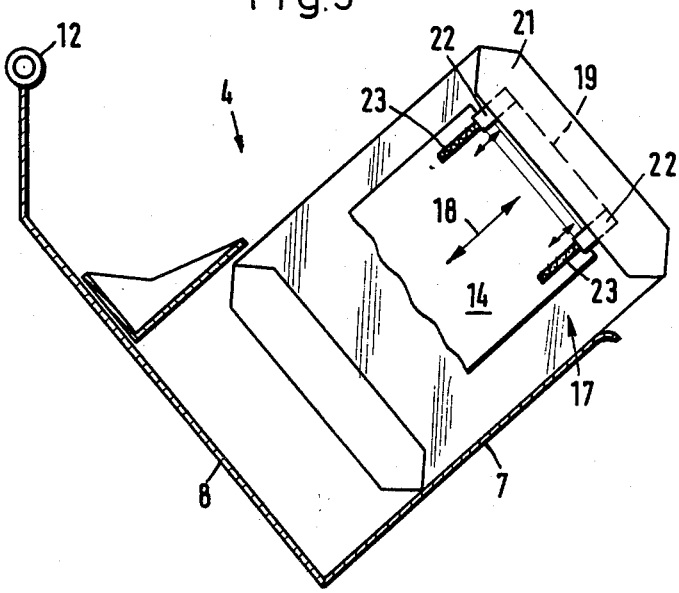
FIG. 5 is a diagram similar to that of FIG. 4 in which an individual bag has already been displaced from the stack.
Figure 6:
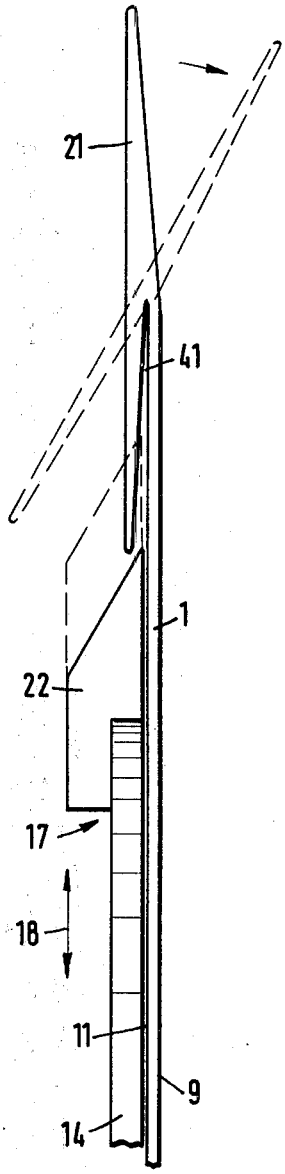
FIG. 6 is an enlarged side view of a single bag and the means for displacing a single bag from the stack in the bag storage container.

When the slide 14 is inserted, the lifter means 22 move downwardly relative to the slide 14, in the direction of the arrow 18, and against the force of the springs 23 so that, when the lifting process is completed, the mechanism attains the position shown in FIG. 5, where it may be seen that the upper edge 19 of the slide 14 is flush with the lifter means 22, the latter being embodied in the present case as two sliding fingers.

This condition is illustrated in the left portion of FIG. 1. Prior to reaching this condition, the pivotal arm moves downwardly in the direction of the arrow 43 and after a short time, the roller 26 engages the top 21 of the individual bag 1. In doing so, it completely folds over the top 21 which had already been placed in the oblique position shown in FIG. 6 and, near a point 44, it meets the upper edge of the slide 14 which is omitted from FIG. 1 for the sake of clarity. The force of this meeting tips the seesaw 31 from the position shown in the left portion of FIG. 1 in the direction of the arrow 46. The new position is seen in the middle portion of FIG. 1, the pivot arm and the members attached to it having been drawn in somewhat finer lines.

When the seesaw 31 tips over, the opening means 28 engages beneath the top 21 of the individual bag 1. In addition, the pressure-stop means 33 is brought into contact with the rear portion of the top 21 of the bag and holds it down, whereas the opening means 28 opens the valve means 30 so that it assumes the shape shown schematically in FIG. 2. In the meantime, the actuating means 37 moves the receiver 34 from the position drawn in broken lines in FIG. 2 into the position shown by solid lines so that the lever arm portions 36 contact the bag 1. Subsequently, the pivotal arm 6 moves from the position drawn with fine lines in FIG. 1 into the position drawn with broken lines wherein the valve 30 is slid over the filling spout 2. In this position, the pivotal arm 6 engages the switch 38 and, as a result, the cylinder-piston assembly 37 is actuated in the reverse direction, thus returning the lever arm portion 36 to the position shown in broken lines in FIG. 2. Furthermore, the seesaw 31 is tipped back from its second position to its first position. Finally, the pivotal arm 6 is moved back to its starting position in the direction of arrow 43 and the entire process may then be repeated.

In the event of malfunction, the bag storage container 4 may be pivoted further to the left into the position shown in broken lines in FIG. 1. In addition, it is possible to move the pivotal arm 6 upwardly into a non-operational position (not represented in FIG. 1), so that the filling spout 2 is readily accessible and may be serviced by hand.

FIGS. 7 through 11B show a variant of the apparatus according to the invention which also includes a bag storage container 4 (see FIG. 9) whose one end 5 releases bags 1. The apparatus further includes a pivotal arm 6 with a receiver for the bags 1 by means of which an individual bag 1 may be taken from the bag storage container 4 or, more precisely, from the single bag release mechanism to be described below, and may be mounted on the filling spout 2 after the valve of the bag has been opened.

The bag storage container 4 of this embodiment of the invention has mutually perpendicular supports 7 and 8 which support and guide the stored bags 1 and which are so disposed that the front walls 9 and rear walls 11 of the bags lie in a substantially vertical plane.

As may be seen especially from FIG. 9, the stored bags 1 are held in the bag storage container 4 between two mutually movable stops 13 and 14 which compress the bags in a direction perpendicular to their side walls, i.e., in the direction of the arrows 16. The stop 14 also serves as a structural member of the bag feed mechanism as will be described below. The second stop means 13 is propelled by drive means (not shown) in the direction of the arrow 16 and the compressive force which it exerts is adjustable. The stop 14 is locally fixed but may rotate about the pivotal axis 15.

A single bag feed mechanism 17 is associated with the bag storage container 4. The mechanism 17 includes a rotating member which is identical with the locally fixed stop 14 and which partially overlaps the delivery end 5 of the container 4 and which makes contact with the first bag 1' in the stack of bags. The pivotal axis 15 of the rotatable member 14 is also parallel to an axis 15' which is perpendicular with respect to the front walls 9 and the rear walls 11 of the stored bags 1. The pivotal aixs 15 lies outside of the main components of the bag storage container 4, i.e., of the storage box for the bags 1 within the storage container 4.

Figure 8:
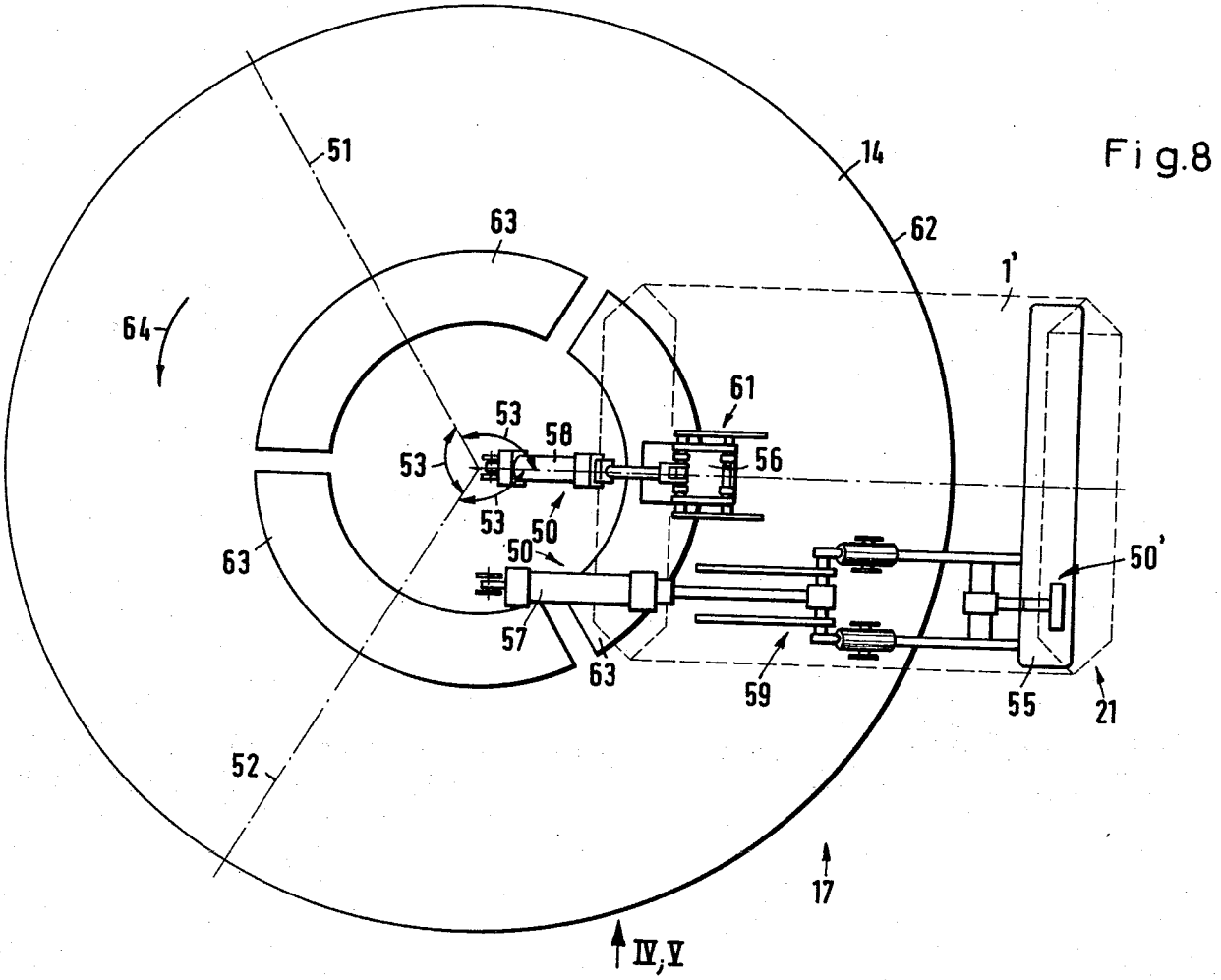
FIG. 8 is a section of FIG. 7 wherein the rotating disc is shown with one gripper means.

The single bag feed mechanism 17 includes three sets of gripper means 50, located on that side of the disc-shaped rotating stop 14 remote from the storage container. Only one of the three gripper means 50 is shown in FIG. 8. The other two gripper means 50 are located in a corresponding manner on the symmetry axes 51 and 52 and are mutually displaced by an angle 53; the angle 53 between all three gripper means 50 is the same.

The rotatable disc 14 is driven in a stepwise manner, by means of a drive mechanism 54, and each stepwise motion results in a rotation by an angle equal to the angle included between two adjacent gripper means 50. As may be seen especially from FIGS. 8, 10A, 10B, 11A and 11B, each gripper means 50 consists of a pair of slides 55, 56, which may move from a rest position (FIG. 9, 10A, 11A) into an operational position (FIG. 8, 10B, 11B) in which they engage a bag 1 or 1' by entering the folds 41, 41', i.e., the folds between the top 21 and the bottom 20 respectively, and the front wall 9 of the individual bag 1 with which they are in contact, until they reach the edge of the folds 42, 42' (see FIGS. 10B, 11B). In the extended position, a clamp means 50' also engages the top 21 of the bag 1 and holds it securely to insure that the bag will be carried along by the rotatable member 14. The drive means for the clamp 50' has not been shown in the drawing for purposes of clarity, but it includes a cylinder-piston assembly. For the same reason, the clamp means 50' has been shown only in FIGS. 8 and 10B.

As may be seen especially from FIGS. 10A, 10B, 11A, and 11B, the slides 55 and 56 may be moved toward the front wall 9 of the bag 1' at an acute angle therewith by a cylinder-piston assembly 57 and 58, respectively. The motion of the slide 55 is controlled by a cam follower mechanism 59 whereas the motion of the slide 56 is produced by a parallelogram 61. The rotatable member 14 has a penetration 63 for each gripper means 50, located between the pivotal axis 15 and the outer perimeter or edge 62. Through this perforation 63, one slide 56 of the suitably located gripper means 50 may engage the bottom fold 41' of the individual bag 1'.

The method of operation of the apparatus shown in FIGS. 7 to 11B and described above is as follows:

The bag sotrage container 4 may contain a stack of approximately 200 bags 1, for example. The bags 1 are held in position as seen in FIG. 3 between the stop 13 which acts as a slide and the rotatable member 14 which also serves as a stop means. The stop 13 is moved continuously by means of a motor (not shown in the drawing), which may operate, for example via an eccentric plate.

Figures 10A, 10B, 11A, 11B:
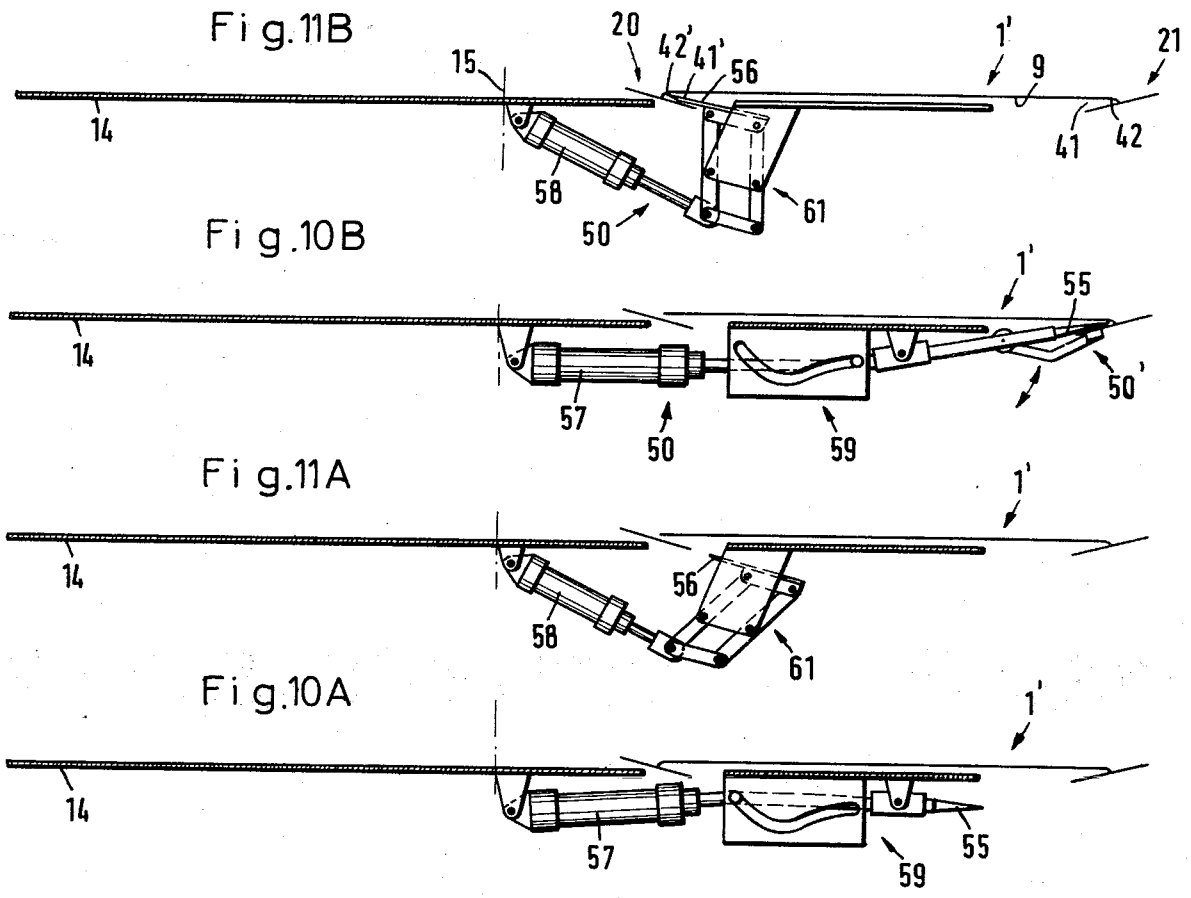
FIG. 10A is a view in the direction of the arrow IV/V in FIG. 8 of the front portion of the gripper means in its rest position.
FIG. 10B is similar to FIG. 10A except that the front portion of the gripper means is extended to its gripping position.
FIG. 11A is similar to FIG. 10A and shows the rear portion of the gripper means in its rest position.
FIG. 11B is similar to 11A except that the rear portion of the gripper means is shown in its extended operational position.

At the delivery end 5 of the bag container 4, the front wall 9 of the first bag 1' lies up against the stop member 14 while the slides 55, 56 of the gripper means 50, which are in the position according to FIG. 2, are retracted as seen in FIGS. 10A and 11A. Subsequently, the slides 55 and 56 are extended by the cylinder piston assemblies 57, 58, respectively, until they reach the position shown in FIGS. 10B and 11B. The slide 55 extends beyond the outer edge 62 of the machine member 14, whereas the slide 56 is moved through the appropriate perforation 63. In this operational position, the front edges of the slides 55 and 56 have been introduced into the folds 41 and 41', respectively, and now are in contact with the respective edges of these folds.

Figure 7:
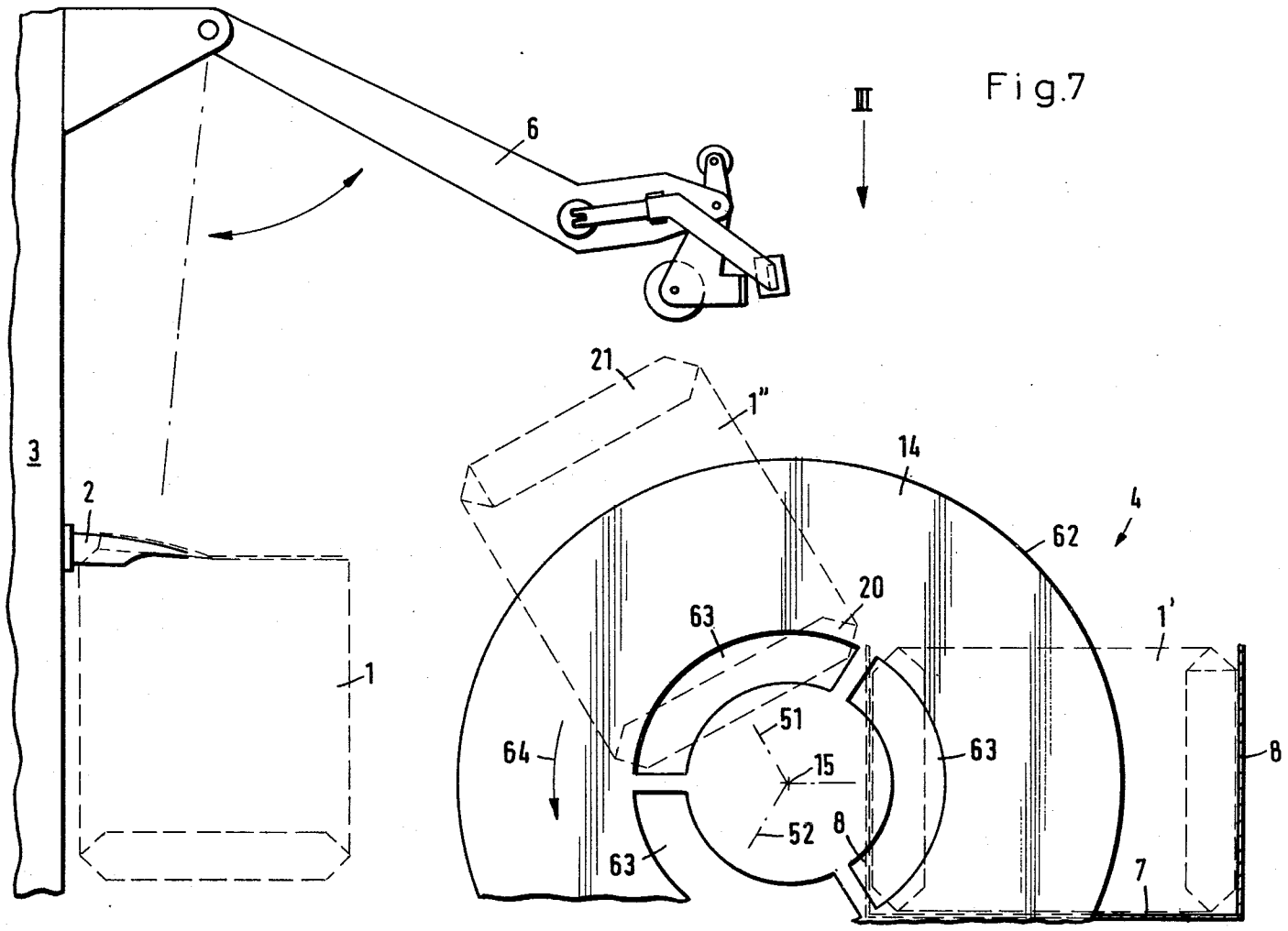
FIG. 7 is a side elevational view of a second embodiment of an apparatus for attaching valve bags to the filling spout of a filling machine, as seen in the direction of the arrow I in FIG. 9, the gripper means having been omitted for clarity.

Subsequently, the drive means 54 move the machine member 14 ahead by an angle 53 in the direction of the arrow 64 so that the bag 1' located at the lower right as seen in FIG. 7 assumes the position 1'' in that view.

In this position, the bag 1'' is picked up by the pivotal arm 6 and is mounted on the filling spout 2 of the filling machine 3 as is described above in relation to FIGS. 1 to 6.

In the meantime, the gripper means 50 located on the symmetry axis 52 (FIG. 8) has moved into the position in which it may receive a bag 1'.

Thus, one gripper means 50 is always located in the position shown in FIG. 8 in which it receives a bag 1' from the container, whereas a further gripper means 50 (not shown) is located on the symmetry axis 51 in FIG. 7 in which it may deliver a bag 1'' as explained above. A third gripper means, also not shown, always occupies the position on the symmetry axis 52 of FIG. 8.

In principle, the axes 15 and 15' could also be vertical, and in that case, it would be suitable to rotate the pivotal arms 6 in a horizontal plane. If this is done, it is not necessary to also pivot the individual bag to be picked up so that, even in an apparatus designed in this manner, a substantially higher capacity may be achieved in principle and this is so because a bag attached in a horizontal position moves into a vertical position by itself when it is being filled with material. To permit this motion, it is only necessary to provide such fastening means (not shown) for the individual bag 1 on the filling spout 2 which are capable of yielding elastically so that the bag 1 may rotate on the filling spout 2 from its horizontal into its vertical position. However, the vertical disposition of the bags 1, substantially as described above and shown in the drawing, is the preferred position.

Figure 12:
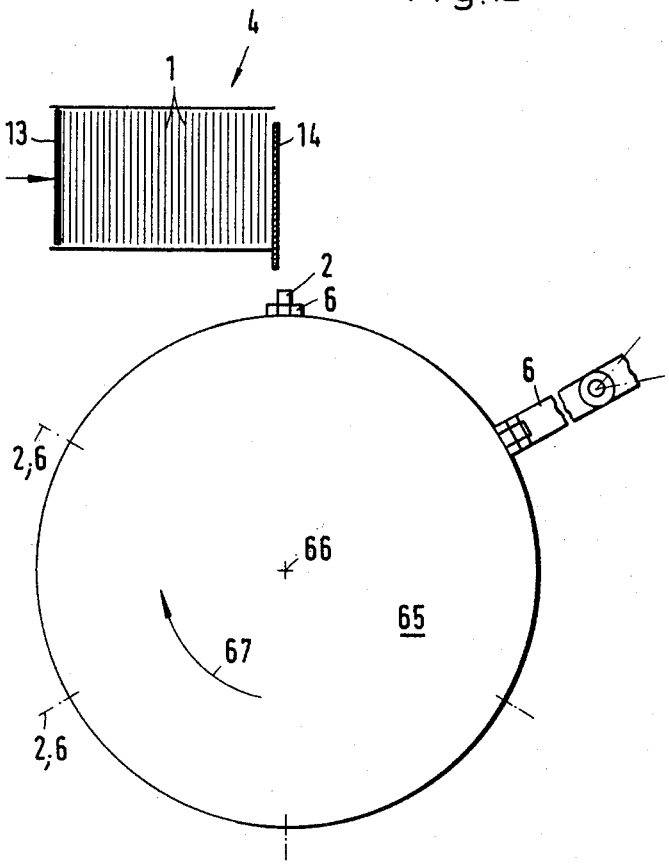
FIG. 12 is a schematic top view of a rotatable (round) filling machine having a plurality of attachment apparatuses according to the present invention.

FIG. 12 depicts a filling machine 65 for filling valve bags 1 with finely grained pourable material such as cement. The filling machine 65 rotates about a vertical axis 66 in the direction of the arrow 67.

The circumference of the filling machine 65 is provided with several filling spouts 2 on which valve bags 1 are to be placed for filling.

Each filling spout 2 of the filling machine 65 is provided with a bag mounting apparatus according to the invention, including a pivotal arm 6, as described above with reference to FIGS. 1 to 11.

However, in this case, and in contrast to a sequential filling machine, only a single bag storage container 4 is provided for the totality of filling spouts 2.

It is possible to drive the filling machine 65 in a stepwise manner by means not shown.

It is preferred, however, to drive the filling machine 65 continuously, i.e., to rotate it continuously about its axis 66. This requires that the pivotal arm 6 be embodied so as to be capable of lagging the motion of the filling machine 65, i.e., they must be attached pivotably in a plane which is transverse to their vertical pivotal plane since the attachment process requires a finite amount of time, during which the arms 6 must be stationary while the machine 65 is rotating.

The embodiment of the filling machine 65, including pivot arms 6, as described above, has the advantage that only a single bag storage container 4 is required since the attachment of a bag at a mounting station temporarily associated with the container 4 takes place while the remaining rotating platform is used for filling and delivering the filled bags.

It will be recognized that the apparatus according to the invention is an extraordinarily simple and robust apparatus which is easily capable of withstanding the heavy-duty service in cement factories. Furthermore, it may be seen that, by avoiding any unnecessary pivotal rotation or folding motions of the bags 1, the apparatus moves only through very short paths not requiring complicated control processes so that a very short cycling time results. As a consequence, the efficiency of the apparatus is such that the bag storage container may have a very large capacity, as large as desired by comparison to any other part of the apparatus, so that the storage container need be refilled only after considerable periods of operation.

The advantages cited above are derived especially by the particularly suitable embodiment of the pivot arm and the means disposed thereon but the high operational reliability of the apparatus according to the invention does not derive only from the presence of a small number of machine members, but also, among other reasons, from the fact that the few drive means are located outside of the effective spout area and are not directly subject to contamination by filling material when irregularities or malfunctions occur.

A further advantage with respect to known apparatus derives from the fact that when the apparatus must be stopped to effect repairs or for other reasons, a manual operation can be begun immediately without difficulty because the apparatus permits easy accessibility in such cases.

What is claimed is:

1. In an apparatus for mounting valve bags on the filling spout of a material-dispensing filling machine, said apparatus including A. bag storage container means capable of holding a plurality of bags, each having a top, a bottom, side walls and valve means;

B. pivot arm means pivotably attached to a locally fixed pivot joint;

C. receiver means, attached to said pivot arm, for receiving one of said bags from said bag storage container means;

D. opening means, attached to said pivotal arm, for opening the valve means of said one of said bags; the improvement comprising:

E. fold-over means, attached to the free end of said pivot arm, for engaging and bending the top of said bag;

whereby the top of the bag is foleded over so as to be substantially perpendicular to the side walls of the bag and the edges of the top are bent in the direction of the bottom of the bag, the top of the bag thereby assuming a roof-shaped cross-section.

2. An apparatus as defined in claim 1, wherein said fold-over means is a roller whose axis of rotation is substantially perpendicular to the pivotal plane of said pivotal arm means.

3. An apparatus as defined in claim 2, wherein the diameter of said roller decreases from either end toward the center; whereby the longitudinal cross-section of the roller is substantially a double cone.

4. An apparatus as defined in claim 1, wherein said opening means is attached to the end of the pivotal arm remote from its pivot joint, said opening means further including funnel-shaped means having a slotted bottom zone to permit engagement thereof with one of said bags.

5. An apparatus as defined in claim 4, wherein said fold-over means and said opening means are disposed on a common seesaw which is pivotally mounted on the free end of said pivotal arm and may occupy a first position in which the fold-over means engages the top of a bag and may be pivoted into a second position in which the fold-over means disengages from the top of the bag.

6. An apparatus as defined in claim 5, wherein said opening means is so located that it engages the top of the bag when said seesaw is in its said second position.

7. An apparatus as defined in claim 5, wherein said fold-over means and said opening means are disposed at one end of said seesaw and wherein a pressure stop is disposed at the other end of said seesaw and engages the top of the bag in said second position of said seesaw.

8. An apparatus as defined in claim 7, wherein said pressure stop is embodied as a roller.

9. An apparatus as defined in claim 1, the improvement further comprising

F. holding means, attached to the end of said pivotal arm means remote from the pivot joint and embodied as clamp means for clamping the individual bag to be mounted on the filling spout.

10. An apparatus as defined in claim 9, wherein said holding means is a system of levers and wherein two mutually opposite, pad-like lever regions are pressed against mutualy opposite side walls of said bag below the top thereof.

11. An apparatus as defined in claim 9, wherein said holding means are actuated by a cylinder-piston assembly.

12. An apparatus as defined in claim 9 wherein said holding means include control means for disengaging the holding means from the bag after mounting the valve means of said bag on said filling spout.

13. An apparatus as defined in claim 1 wherein said bag storage container means includes two stop means between which is held a plurality of bags, and wherein one of said stop means is movable in a direction perpendicular to the side walls of said bags, whereas the other one of said two stop means is fixed in the direction perpendicular to the side walls of said bags.

14. An apparatus as defined in claim 13 wherein said locally fixed stop means is provided with pressure means which tend to move said plurality of bags away from said locally fixed stop means in the direction of said movable stop means.

15. An apparatus as defined in claim 13, wherein said locally fixed stop means is a panel-like slide means, capable of sliding motion in a plane parallel to the side walls of said plurality of bags, whose top edge extends over a substantial portion of the width of said bags and which includes lifter means which may engage the top of the first one of said plurality of bags, thereby bending the top of said first bag from a position substantially parallel to said side walls into an inclined position with respect to said side walls.

16. An apparatus as defined in claim 15, wherein said lifter means include springs arranged to urge the lifter means away from said panel-like sling means and wherein said lifter means is tapered away from said panel-like slide means and is mounted slidably with respect to the longitudinal direction of said panel-like slide means.

17. An apparatus as defined in claim 16, wherein said pivotal arm means and said bag storage container means are so disposed that said panel-like slide means on said bag storage container means engages said fold-over means to effect the tipping motion of said seesaw.

18. An apparatus as defined in claim 1, wherein said bag storage container means includes two mutually movable stop means between which is held a plurality of bags and wherein one of said stop means is movable in a direction perpendicular to the side walls of said bags whereas the other stop means is locally fixed in a direction perpendicular to the side walls of said bags and wherein said second, locally fixed, stop means is capable of rotation about an axis substantially parallel to the direction perpendicular to the side walls of said stored bags and wherein said rotatable stop means includes at least one gripper means for engaging the first one of said plurality of bags for transport through an angular fraction of one revolution of said rotatable stop means.

19. An apparatus as defined in claim 18, wherein a plurality, preferably three, gripper means are provided on said rotatable stop means.

20. An apparatus as defined in claim 19, wherein the angles between adjacent gripper means are equal.

21. An apparatus as defined in claim 18, wherein said gripper means are mounted lying in a plane which is perpendicular to the rotational axis of said rotatable stop means.

22. An apparatus as defined in claim 21, wherein said rotatable stop means is substantially disc-shaped.

23. An apparatus as defined in claim 22, wherein said gripper means is disposed on that side of said rotatable stop means remote from said plurality of bags.

24. An apparatus as defined in claim 23, further including drive means for rotating said rotatable stop means in a stepwise manner, each step corresponding to an angle equal to the angle between two adjacent gripper means.

25. An apparatus as defined in claim 24, wherein each gripper means includes first and second slides, each capable of being extended so as to engage the fold between the top of a bag and a side wall and the bottom of the bag and a side wall, respectively.

26. An apparatus as defined in claim 25, wherein said first and second slides may be moved slidably in a direction which makes an acute angle with the side wall of said bag and including an actuating cylinder piston assembly for actuating said first and second slides.

27. An apparatus as defined in claim 25, wherein said rotatable stop means is provided with at least one perforation, there being one perforation associated with each gripper means disposed on said rotatable stop means, whereby said gripper means may engage part of said first one of said plurality of bags through said at least one perforation.

28. An apparatus as defined in claim 27, wherein said gripper means includes clamping means for clamping said bag.

29. An apparatus as defined in claim 28, and including actuating means for moving said movable stop means toward said plurality of bags contained in said bag storage container means, wherein the force produced by said actuating means is adjustable.

30. A filling machine for filling valve bags with finely grained pourable material, for example cement, said filling machine being driven rotatably about a vertical axis and being provided with a plurality of filling spouts disposed on its circumference in mutually displaced manner, on which valve bags are to be mounted for filling, the improvement comprising a plurality of mounting apparatuses, one apparatus being associated with each one of said plurality of filling spouts, each mounting apparatus including:

A. bag storage container means capable of holding a plurality of bags, each having a top, a bottom, side walls and valve means;

B. pivot arm means pivotably attached to a locally fixed pivot joint;

C. receiver means, attached to said pivot arm, for receiving one of said bags from said bag storage container means;

D. opening means, attached to said pivotal arm, for opening the valve means of said one of said bags; and:

E. fold-over means, attached to the free end of said pivot arm, for engaging and bending the top of said bag;

whereby the top of the bag is folded over so as to be substantially perpendicular to the side walls of the bag and the edges of the top are bent in the direction of the bottom of the bag, the top of the bag thereby assuming a roof-shaped cross-section.

31. A filling machine as defined in claim 30, wherein said filling machine is rotated in a stepwise manner.

32. A filling machine as defined in claim 30, wherein said filling machine is rotated in a continuous manner and wherein the pivot arms of said mounting apparatuses are capable of movement in a direction perpendicular to their pivotal plane.

* * * * *